US007333765B2

(12) United States Patent
Kubo

(10) Patent No.: US 7,333,765 B2
(45) Date of Patent: Feb. 19, 2008

(54) IMAGE FORMING APPARATUS

(75) Inventor: Yutaka Kubo, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 99 days.

(21) Appl. No.: 10/919,368

(22) Filed: Aug. 17, 2004

(65) Prior Publication Data

US 2005/0047841 A1 Mar. 3, 2005

(30) Foreign Application Priority Data

Aug. 28, 2003 (JP) ..... 2003-303951

(51) Int. Cl.
*G03G 15/00* (2006.01)

(52) U.S. Cl. ..... 399/405; 399/110

(58) Field of Classification Search ..... 399/405, 399/110, 107; 271/3.01–3.03; 400/625
See application file for complete search history.

(56) References Cited

U.S. PATENT DOCUMENTS

| | | | | |
|---|---|---|---|---|
| 4,166,614 | A * | 9/1979 | Hamlin et al. | 271/3.02 |
| 5,188,351 | A * | 2/1993 | Gysling | 271/171 |
| 5,366,216 | A * | 11/1994 | Ahlvin | 271/171 |
| 5,536,000 | A * | 7/1996 | Kelly | 271/189 |
| 5,599,120 | A * | 2/1997 | Conrad et al. | 400/624 |
| 5,746,528 | A * | 5/1998 | Mayer et al. | 400/625 |
| 6,000,779 | A * | 12/1999 | Ng et al. | 347/24 |
| 6,350,029 | B1 * | 2/2002 | Szlucha et al. | 347/104 |
| 6,371,474 | B1 * | 4/2002 | Amano | 271/3.02 |
| 6,382,615 | B1 * | 5/2002 | Ishiguro et al. | 270/58.12 |
| 6,951,428 | B2 * | 10/2005 | Bingham et al. | 400/624 |
| 2005/0201792 | A1 * | 9/2005 | Park et al. | 399/393 |

FOREIGN PATENT DOCUMENTS

| | | | |
|---|---|---|---|
| JP | 58-10438 | | 7/1956 |
| JP | 54-99619 | | 7/1979 |
| JP | 59-11854 | | 1/1984 |
| JP | 4-37154 | | 3/1992 |
| JP | 10059608 | A * | 3/1998 |
| JP | 10077139 | A * | 3/1998 |
| JP | 8-119517 | | 5/1998 |
| JP | 2004168471 | A * | 6/2004 |

OTHER PUBLICATIONS

Japanese Office Action for Japanese Patent Application No. 2003-303951 dated Apr. 21, 2006.

* cited by examiner

*Primary Examiner*—Anthony H. Nguyen
(74) *Attorney, Agent, or Firm*—Crowell & Moring LLP

(57) ABSTRACT

An image forming apparatus having a discharge port for discharging a sheet after forming an image on the sheet by an image forming portion, and a discharge tray disposed on a downstream side of the discharge port for laminating the sheet discharged from the discharge port, which is formed with a plurality of partition regions in a square shape respectively adapted to a plurality of kinds of sheet modes discharged to the discharge tray.

16 Claims, 8 Drawing Sheets

IMAGE FORMING APPARATUS

BACKGROUND OF THE INVENTION

1. Field of the Invention

The present invention relates to an image forming apparatus having a discharge tray of a sheet leaf type of, for example, a copier, a printer, a printing machine or the like, particularly, sheets discharged from a discharge port after forming an image are made to be able to align extremely simply.

2. Description of the Related Art

As is well known, there is a printer of a sheet leaf type in which a carrying reference is constituted by one side end portion in a direction of discharging a single leaf of sheet including cut paper, a desired image is formed by an image forming portion based on the carrying reference and thereafter, the sheet is discharged from a discharge port to a discharge tray along a side plate constituting the carrying reference by a carrying mechanism including a discharge roller or the like to successively laminate the sheet above the discharge tray (refer to, for example, JP-UM-A-58-10438).

However, according to the above-described constitution described in JP-UM-A-58-10438, the sheet after forming the image is successively laminated above the discharge tray simply along the side plate constituting the carrying reference and therefore, there poses a problem that four corners of the respective sheets are not aligned and in dealing therewith thereafter, for example, when there is carried out a binding processing for binding data by punching the data and using a binding piece of a stapler or the like, further, a string or the like, the data is obliged to realign at each time, which is not only inconvenient but also time is taken in the operation.

SUMMARY OF THE INVENTION

The invention has been carried out in order to resolve the above-described problem and it is an object thereof to provide an image forming apparatus capable of simply aligning a sheet after forming an image.

In order to achieve such an object, according to a first aspect of the invention, there is provided an image forming apparatus having a discharge port for discharging a sheet after forming an image on the sheet by an image forming portion and a discharge tray disposed on a downstream side of the discharge port for laminating the sheet discharged from the discharge port, wherein the image forming apparatus is formed with a plurality of partition regions in a square shape respectively adapted to a plurality of kinds of sheet modes discharged to the discharge tray. Further, in the specification, 'sheet mode' refers to a combination of a size (for example, A4, B4, postcard etc.) of a sheet forming an image and a direction of printing (longitudinal direction, transverse direction). Therefore, there are two kinds of the sheet modes (for example, A4 longitudinal side, A4 transverse side) of a sheet of each size.

According to a second aspect of the invention, there is provided an image forming apparatus having a discharge port for discharging a sheet after forming an image on the sheet by an image forming portion and a discharge tray disposed on a downstream side of the discharge port for laminating the sheet discharged from the discharge port, wherein the image forming apparatus is formed with a partition region in a square shape adapted to a sheet mode discharged to the discharge tray.

According to a third aspect of the invention, the partition region in the square shape is formed by a dropping groove.

According to a fourth aspect of the invention, the image forming apparatus includes the plurality of partition regions in the square shape, forms other of the partition regions in the square shape at inside of one of the partition regions in the square shape and provides a fitting auxiliary member attachably and detachably to and from the other partition region in the square shape.

According to a fifth aspect of the invention, an attaching and detaching groove for attaching and detaching the auxiliary member is formed at least one side on a boundary line of the removable fitting auxiliary member.

According to a sixth aspect of the invention, a raised portion in a curved shape is formed at an end portion orthogonal to a direction of discharging the sheet in the boundary lines of the removable fitting auxiliary member.

According to a seventh aspect of the invention, a sheet laminating face of the partition region in the square shape is made to be inclined to a discharge tray face.

According to a eighth aspect of the invention, the inclination is formed toward any one corner of the partition region in the square shape.

According to a ninth aspect of the invention, a take-out groove for taking out the sheet laminated on the partition region in the square shape is formed at a position brought into contact with at least one side of the partition region in the square shape.

According to a tenth aspect of the invention, a portion of the take-out groove is extended to below a sheet laminating face.

According to the constitution of the first aspect of the invention, the sheets after forming the image are discharged to the partition region in the square shape in correspondence with each sheet mode and four corners of respective sheets are substantially aligned while being laminated successively. Therefore, a binding processing for binding data by punching and using a binding piece of a staple or the like, further, a string or the like thereafter can be carried out simply and in a short period of time to thereby achieve effects of facilitating to deal with the data and enabling to deal with a plurality of kinds of sheet modes.

According to the constitution of the second aspect of the invention, the sheets after forming the image are discharged to the partition region in the square shape in correspondence with each sheet mode and four corners of respective sheets are substantially aligned while being laminated successively. Therefore, a binding processing of binding data by punching and using a binding piece of a staple or the like, further, a string or the like thereafter can be carried out simply and in a short period of time to achieve an effect of facilitating to deal with the data or the like.

According to the constitution of the third aspect of the invention, the discharge tray may be formed with the dropping groove in correspondence with the sheet mode and the constitution is extremely simple and convenient.

According to the constitution of the fourth aspect of the invention, by attaching and detaching the fitting auxiliary member, the plurality of sheet modes can be delt with extremely simply, which is convenient.

According to the constitution of the fifth aspect of the invention, the fitting auxiliary member can be attached and detached extremely simply and therefore, the constitution is convenient.

According to the constitution of the sixth aspect of the invention, even when the fitting auxiliary member is used, there is not any danger of catching the sheet by a boundary face thereof, which is preferable.

According to the constitution of the seventh aspect of the invention, the sheet laminating face of the partition region in the square shape is inclined to the discharge tray face and therefore, the successively laminated sheets are firmly be aligned and therefore, the constitution is preferable.

According to the constitution the eighth aspect of the invention, the sheet laminating face of the partition region in the square shape is inclined to the discharge tray face toward the one corner and therefore, the successively laminated sheets can be aligned further firmly and therefore, the constitution is preferable.

According to the constitution of the tenth aspect of the invention, the finger can be put into the take-out groove and therefore, the sheets laminated at the partition region in the square shape can simply be taken out, which is convenient.

According to the constitution of the tenth aspect of the invention, the finger can be put to below the sheet laminating face and therefore, the sheets laminated at the partition region in the square shape can be taken out extremely simply, which is preferable.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

There is provided an image forming apparatus having a discharge port for discharging a sheet after forming an image on the sheet by an image forming portion, and a discharge tray disposed on a downstream side of the discharge port for laminating the sheet discharged from the discharge port, including a plurality of partition regions in a square shape including dropping groves respectively adapting to a plurality of kinds of sheet modes discharged to the discharge tray, forming other partition region in the square shape in one partition region in the square shape, attachably and detachably providing a fitting auxiliary member in the other partition region in the square shape, and forming an attaching and detaching groove for attaching and detaching the auxiliary member at least on one side on a boundary line of the removable fitting auxiliary member.

Figure 1:
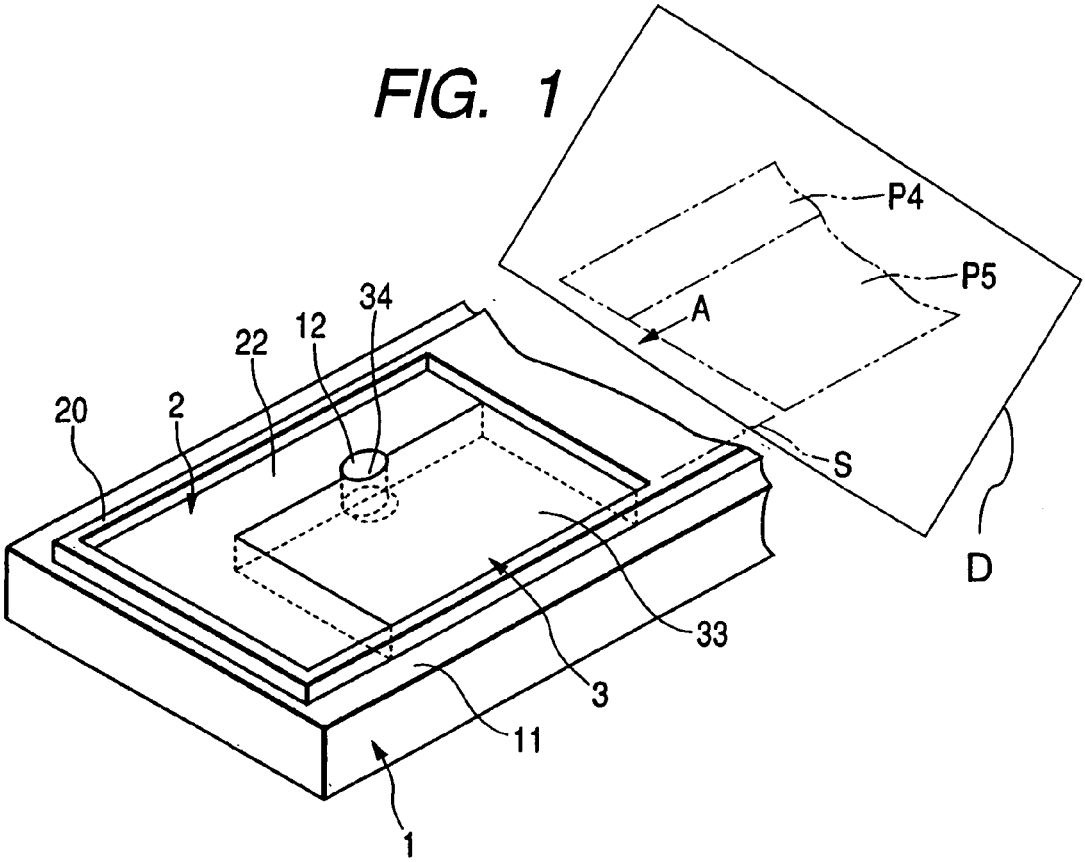
FIG. 1 is a perspective view showing an outline constitution of a discharge tray of an image forming apparatus according to an embodiment of the invention.
Figure 2:
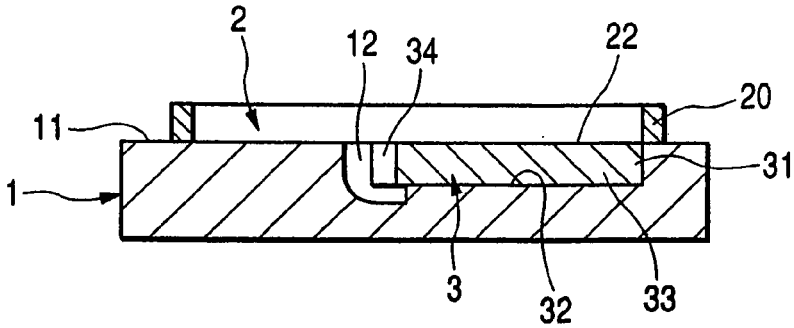
FIG. 2 is a front sectional view of the discharge tray shown in FIG. 1.
Figure 3:
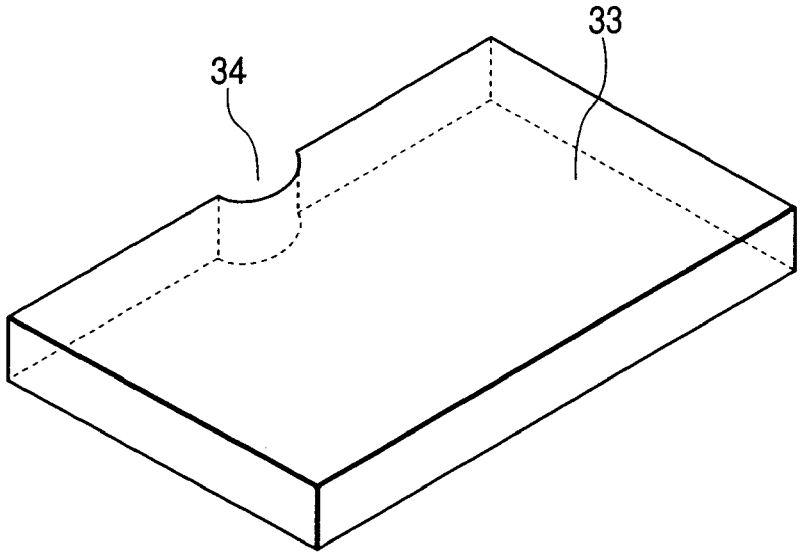
FIG. 3 is a perspective view showing an outline constitution of a fitting auxiliary member used in the discharge tray shown in FIG. 1.
Figure 4:
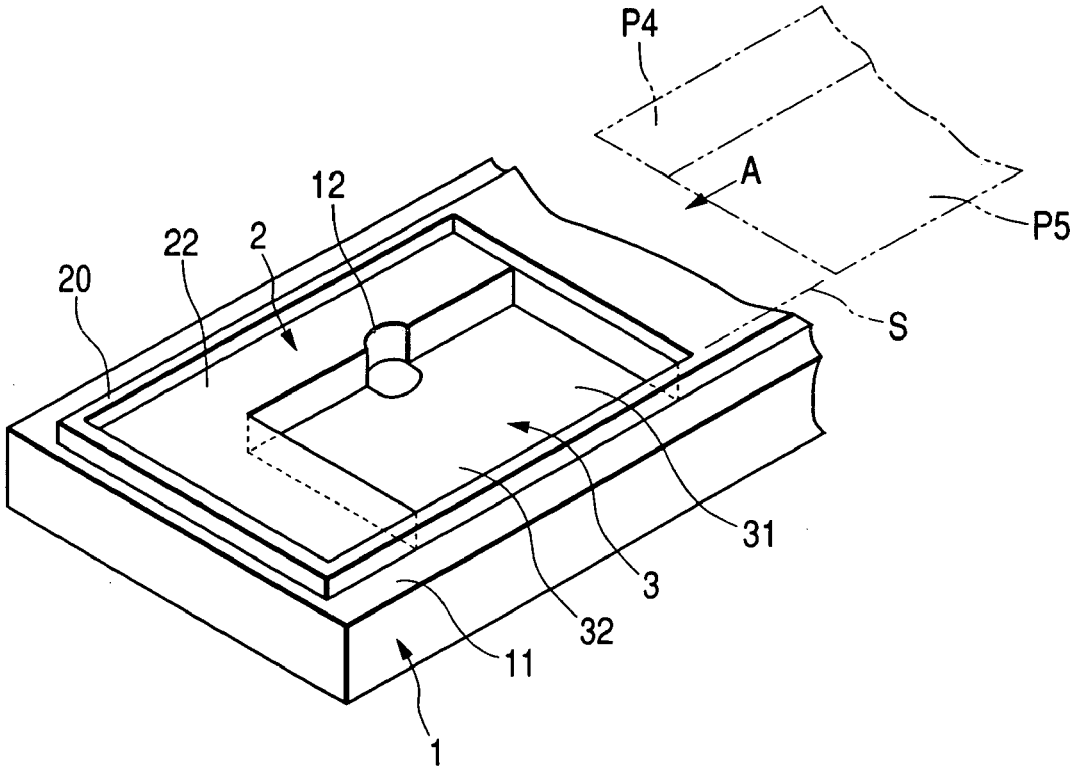
FIG. 4 is a perspective view showing a state of removing the fitting auxiliary member from the discharge tray shown in FIG. 1.

An explanation will be given of an embodiment of the invention in reference to FIG. 1 through FIG. 4 as follows. FIG. 1 is a perspective view showing an outline constitution of a discharge tray of an image forming apparatus according to an embodiment of the invention, FIG. 2 is a front sectional view of FIG. 1, FIG. 3 is a perspective view showing an outline constitution of a fitting auxiliary member used in the discharge tray shown in FIG. 1, and FIG. 4 is a perspective view showing a state of removing the fitting auxiliary member from the discharge tray shown in FIG. 1.

Numeral 1 designates a discharge tray, and the discharge tray 1 is disposed on a downstream side of a discharge port D for discharging a sheet after carrying the sheet along a carrying reference S and forming an image on the sheet by an image forming portion, not illustrated, and laminates the sheet discharged from the discharge port. In the illustrated example, the discharge tray 1 is formed with a first partition region 2 in a square shape and a second partition region 3 in a square shape respectively adapted to two kinds of sheet modes, for example, A4•longtudinal side and B5•longtudinal side.

The first partition region 2 in the square shape is partitioned by a frame member 20 above the discharge tray 1 by constituting a reference by the carrying reference S. A size of the first partition region 2 in the square shape is set to be the same as or more less larger than a size (lateral side: 210 mm×longitudinal side: 297 mm) of a sheet of A4 to form a sheet laminating face 22 for laminating the sheet of A4•longitudinal side. Further, the second partition region 3 in the square shape constitutes a reference by the carrying reference S of the discharge tray 1 and is partitioned by a dropping groove 31 formed at a discharge tray face 11 at inside of the first partition region 2 in the square shape. A size of the second partition region 3 in the square shape is set to be the same as or more less larger than a size (lateral side: 182 mm×longitudinal side: 157 mm) of a sheet of B5 to form a sheet laminating face 32 for laminating the sheet of B5•longitudinal side. Further, the dropping groove 31 forming the second partition region 3 in the square shape is attachably and detachably fit with a fitting auxiliary member 33. Further, notation A in the drawing designates a direction of discharging a sheet.

When an attaching and detaching groove 34 is formed by notching at least one side of an outer periphery of the fitting auxiliary member 33, the fitting auxiliary member 31 can be attached and detached to and from the dropping groove 3 by putting the finger to the attaching and detaching groove 34 and therefore, attaching and detaching operation thereof is extremely simplified, which is convenient.

Further, as in the illustrate example, the sheet laminated to the second partition region 3 in the square shape may naturally be taken out by providing a take-out groove 12 in a shape of a recess having a section in an L-like shape at a position of the sheet laminating face 22 brought into contact with at least one side of the second partition region 3 in the square shape. In this case, when a portion of the take-out groove 12 is formed to extend the portion to a lower side of the sheet laminating face 32 formed by the second partition region 3 in the square shape as illustrated for laminating the sheet of B5, the finger can be put to a lower side of the sheet of B5 laminated on the sheet laminating face 32 and therefore, the sheet laminated on the second partition region 3 in the square shape can extremely simply be taken out, which is convenient.

Further, the sheet laminated to the first partition region 2 in the square shape may naturally be taken out by providing a take-out groove in a recess shape having a section in an L-like shape similar to the above-described take-out groove 12 at the frame member 20 and at a position brought into contact with at least one side of the first partition region 2 in the square shape of the discharge tray face 11, although not illustrated.

According to the embodiment by the above-described constitution, when an image is formed on, for example, a sheet of A4•longitudinal side by an image forming portion, not illustrated, based on the carrying reference S, the image forming apparatus is operated in a state of fitting the fitting auxiliary member 33 to the dropping groove 31 partitioning the second partition region 3 in the square shape. Then, sheets P4 of A4•longitudinal side discharged from the discharge port are successively laminated in a state of substantially aligning four corners of the sheets above the sheet laminating face 22 of the first partition region 2 in the square shape. Further, when an image is formed on a sheet of B5•longitudinal side, the fitting auxiliary member 33 fit to the dropping groove 31 partitioning the second partition region 3 in the square shape is removed and the image forming apparatus is operated under the state. Then, sheets P5 of B5•longitudinal side discharged from the discharge port are successively laminated in a state of substantially aligning four corners of the sheets above the sheet laminating face 32 of the second partition region 3 in the square shape. Therefore, a binding processing for binding data by punching and using a binding piece of a stapler or the like, further, using a string or the like thereafter can be carried out simply and in a short period of time to achieve effects of not only facilitating to deal with the data but also enabling to deal with a plurality of kinds of sheet modes and the like.

Further, when there are a plurality of kinds (a plurality of pages) of contents of forming images, it is further preferable to constitute a state of operating the image forming apparatus by a face down system, that is, such that the sheets after forming the images are laminated in an order of forming the images (order of pages).

Figure 5:
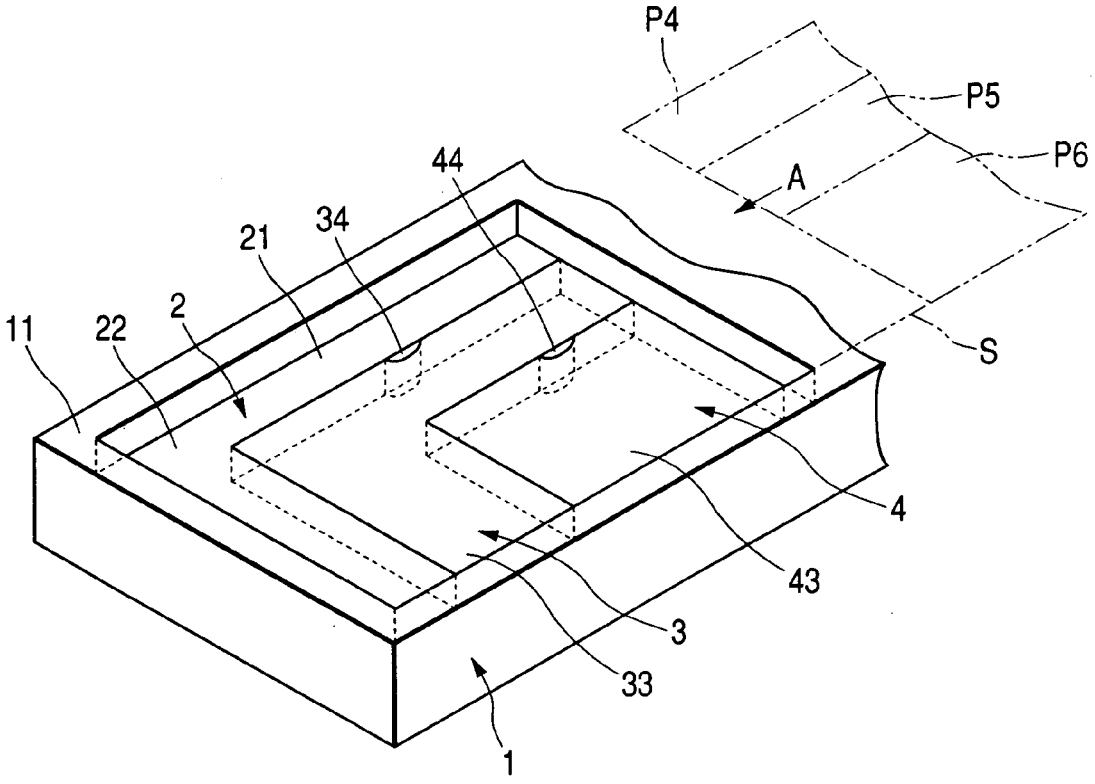
FIG. 5 is a perspective view showing an outline constitution of a discharge tray of an image forming apparatus according to other embodiment of the invention.
Figure 6:
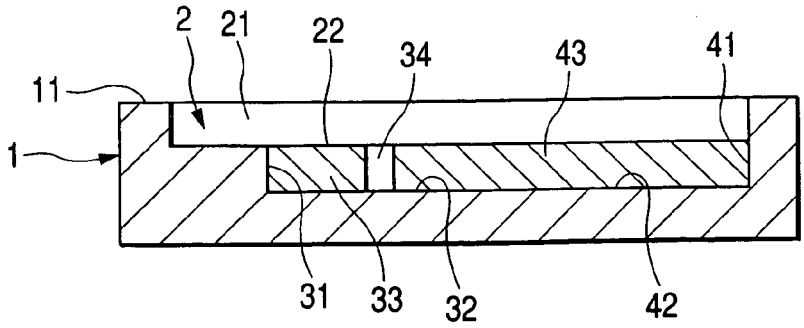
FIG. 6 is a front sectional view of the discharge tray shown in FIG. 5.
Figure 7:
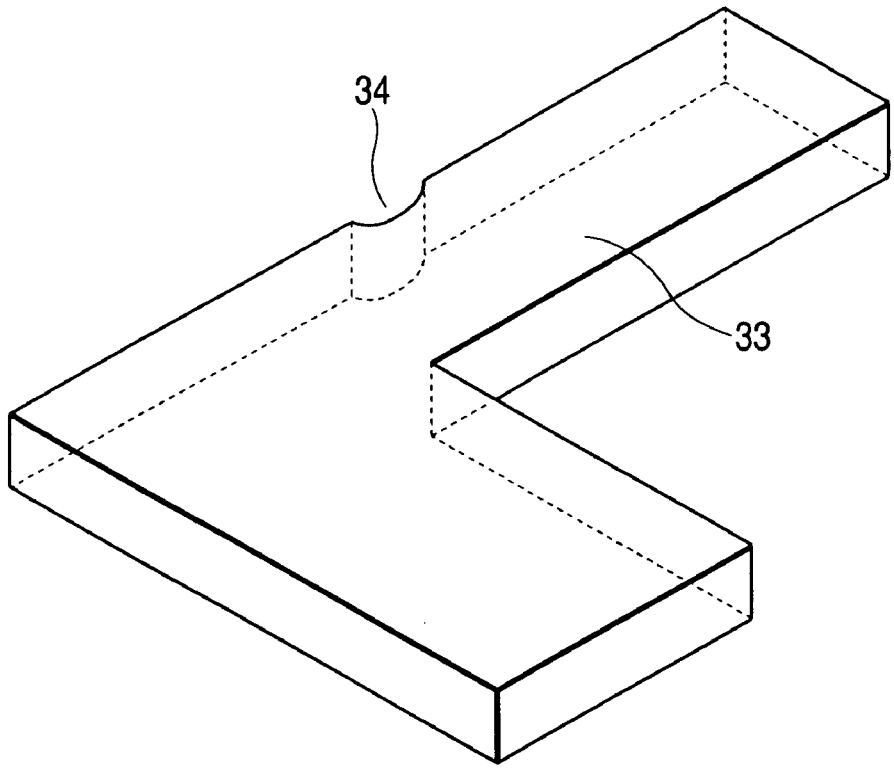
FIG. 7 is a perspective view showing an outline constitution of a first fitting auxiliary member used in the discharge tray shown in FIG. 5.
Figure 8:
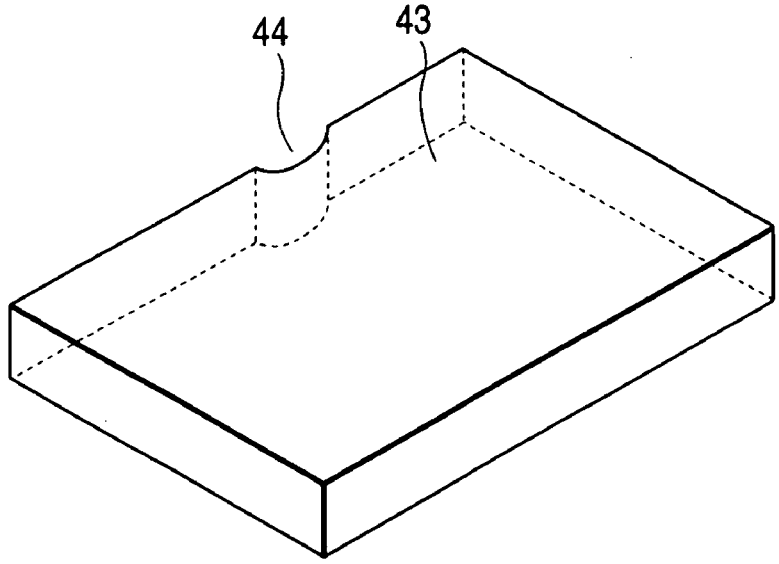
FIG. 8 is a perspective view showing an outline constitution of a second fitting auxiliary member used in the discharge tray similarly shown in FIG. 5.

Next, an explanation will be given of other embodiment of the invention shown in FIG. 5 through FIG. 8. FIG. 5 is a perspective view showing an outline constitution of a discharge tray of an image forming apparatus according to other embodiment of the invention, FIG. 6 is a front sectional view of the discharge tray shown in FIG. 5, FIG. 7 is a perspective view showing an outline constitution of a first fitting auxiliary member used for the discharge tray shown in FIG. 5, and FIG. 8 is a perspective view showing an outline constitution of a second fitting auxiliary member used in the discharge tray shown in FIG. 5. Further, in FIG. 5 through FIG. 8, portions attached with notations the same as those of FIG. 1 through FIG. 4 designate substantially the same portions. An explanation will be given centering on a point of difference as follows.

According to the embodiment, there are formed the first partition region 2 in the square shape, the second partition region 3 in the square shape and a third partition region 4 in a square shape to respectively adapt to three kinds of sheet modes, for example, A4•longitudinal side, B5•longitudinal side and post card•longitudinal side.

The first partition region 2 in the square shape constitutes the reference by the carrying reference S above the discharge tray 1 and is partitioned by the dropping groove 21 formed at the discharge tray face 11. The size of the first partition region 2 in the square shape is set to be the same as or more less larger than the size of the sheet of A4 similar to the above-described embodiment to form the sheet laminating face 22 for laminating the sheet of A4•longitudinal side. Further, the second partition region 3 in the square shape constitutes the reference by the carrying reference S of the discharge tray 1 and is partitioned by the dropping groove 31 formed at the sheet laminating face 22 at inside of the first partition region 2 in the square shape. The size of the second partition region 3 in the square shape is set to be the same as or more less larger than the sheet of B5 to form the sheet laminating face 32 for laminating the sheet of B5•longitudinal side. Further, the third partition region 4 in the square shape constitutes a reference by the carrying reference S of the discharge tray 1 and forms a dropping groove 41 by mounting the fitting auxiliary member 33 in an L-like shape to the third dropping groove 31 and is partitioned thereby. A size of the third partition region 4 in the square shape is set to be the same as or more less larger than a size of a post card (lateral side: 105 mm×longitudinal side: 148 mm) to form a sheet laminating face 42 for laminating a sheet of postcard•longitudinal side. Further, a fitting auxiliary member 43 is attachably and detachably fit to the dropping groove 41 forming the third partition region 4 in the square shape. Further, numeral 44 in the drawing designates an attaching and detaching groove for attaching and detaching the fitting auxiliary member 43.

According to the embodiment by the above-described constitution, when an image is formed on, for example, the sheet of A4•longitudinal side by an image forming portion, not illustrated, based on the carrying reference S, the image forming apparatus is operated in a state of fitting the fitting auxiliary members 33, 43 to the dropping groove partitioning the second partition region 3 in the square shape. Then, the sheets P4 of A4•longitudinal side discharged from the discharge port are successively laminated above the sheet laminating face 22 of the first partition region 2 in the square shape in a state of substantially aligning four corners of the sheets. Further, when an image is formed on the sheet of B5•longitudinal side, the fitting auxiliary members 33, 43 fit to the dropping groove 31 partitioning the second partition region 3 in the square shape and the image forming apparatus is operated under the state. Then, the sheets P5 of B5•longitudinal side discharged from the discharge port are successively laminated above the sheet laminating face 32 of the second partition region 3 in the square shape in a state of substantially aligning four corners of the sheets. Similarly, when an image is formed on the sheet of post card•longitudinal side, the fitting auxiliary member 33 in the L-like shape is fit to the dropping groove 31 partitioning the second partition region 3 in the square shape, only the fitting auxiliary member 43 fit to the dropping groove 41 partitioning the third partition region 4 in the square shape is removed, and the image forming apparatus is operated under the state. Then, sheets P6 of post card longitudinal side discharged from discharge port are successively laminated above the sheet laminating face 42 of the third partition region 4 in the square shape in a state of substantially aligning four corners of the sheets. Therefore, a binding processing for binding data by punching and using a punching piece of a stapler or the like, further string or the like can be carried out simply and in a short period of time to achieve the effects of not only facilitating to deal with the data but also enabling to deal with a plurality of kinds of sheet modes by an extremely simple constitution.

Figure 9:
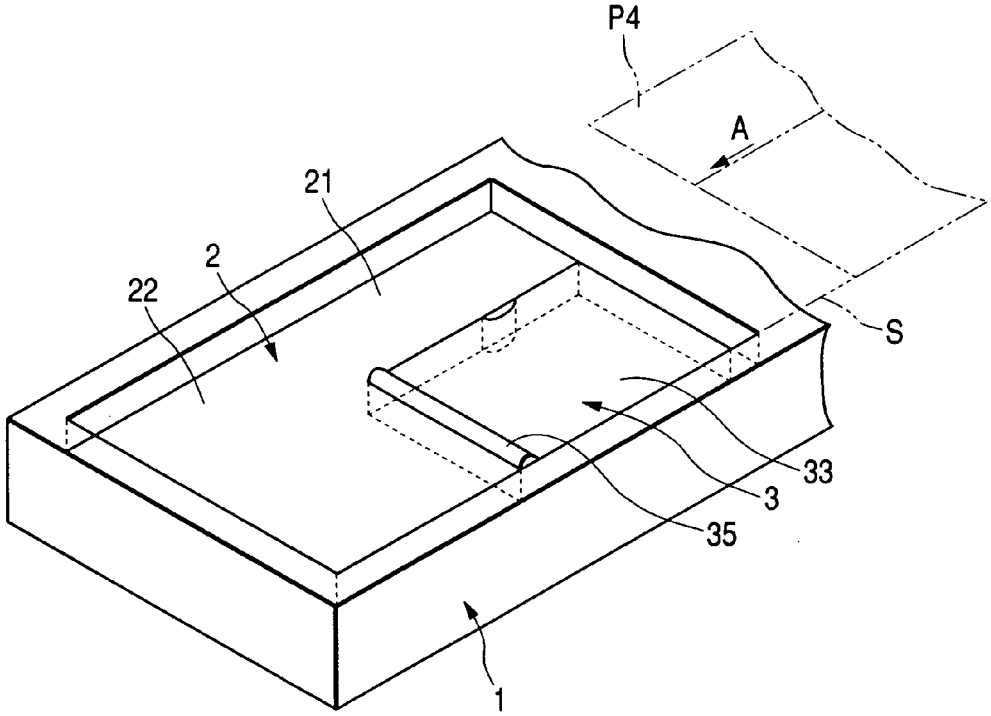
FIG. 9 is a perspective view showing an outline constitution of a discharge tray of an image forming apparatus according to still other embodiment of the invention.
Figure 10:
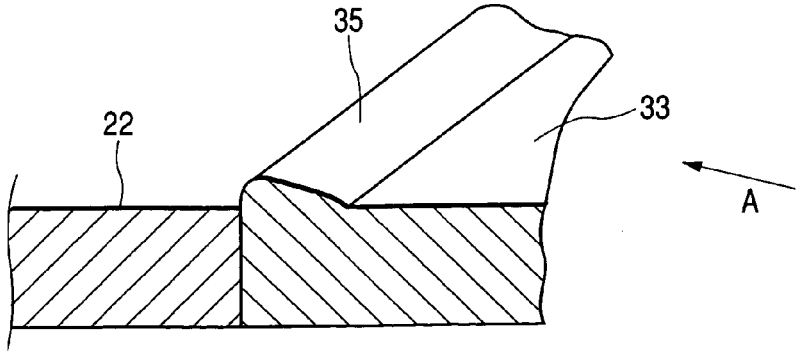
FIG. 10 is a sectional view showing to enlarge an essential portion of the discharge tray shown in FIG. 9.

Next, an explanation will be given of still other embodiment of the invention shown in FIG. 9 and FIG. 10. FIG. 9 is a perspective view showing an outline constitution of a discharge tray of an image forming apparatus according to still other embodiment of the invention, and FIG. 10 is a sectional view showing to enlarge an essential portion of the discharge tray shown in FIG. 9. Further, in FIG. 9 and FIG. 10, portions attached with notations the same as those of FIG. 1 through FIG. 8 designate substantially the same portions. An explanation will be given centering on a point of difference as follows.

According to the embodiment, a raised portion 35 in a curved shape having a height of several millimeters is formed at an end portion on a front end side orthogonal to the direction A of discharging sheets in boundary lines of the removable fitting auxiliary member 33.

According to the constitution, even when, for example, the sheets P4 of A4•longitudinal side in correspondence with the partition region 2 are laminated above the sheet laminating face 22 of the first partition region 2 in the square shape in a state of fitting the fitting auxiliary member 33, there is not any danger of catching the sheets by a boundary face thereof in carrying the sheets and the sheets are laminated in a state of substantially aligning four corners of the sheets and therefore, the constitution is convenient.

Figure 11:
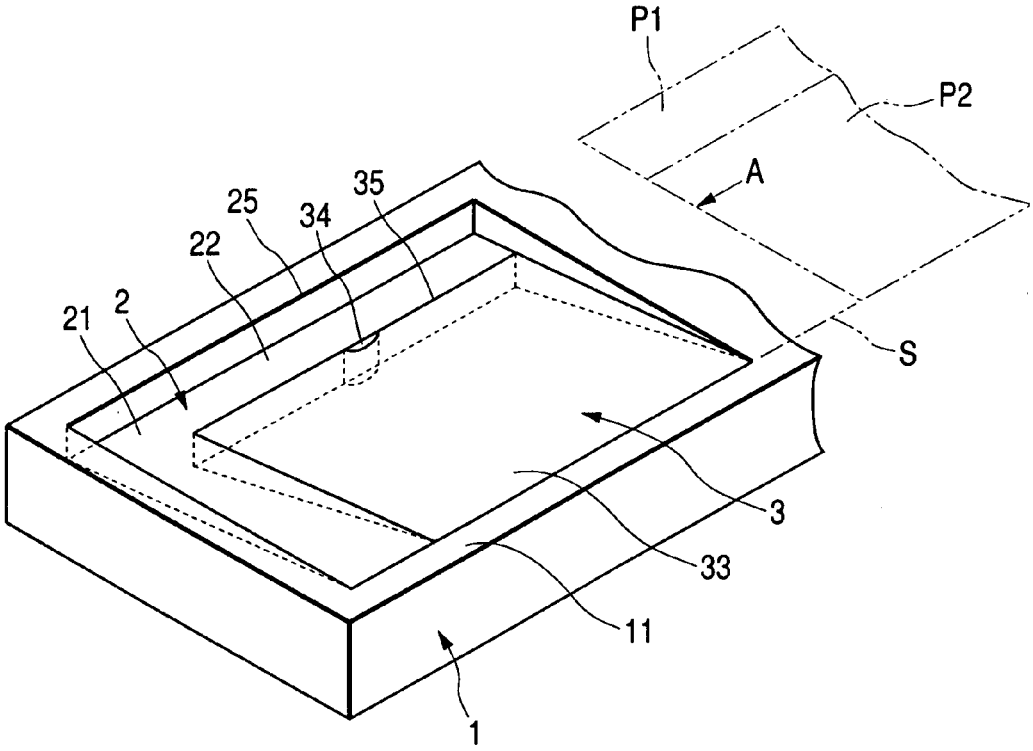
FIG. 11 is a perspective view showing an outline constitution of a discharge tray of an image forming apparatus according to still other embodiment of the invention.
Figure 12:
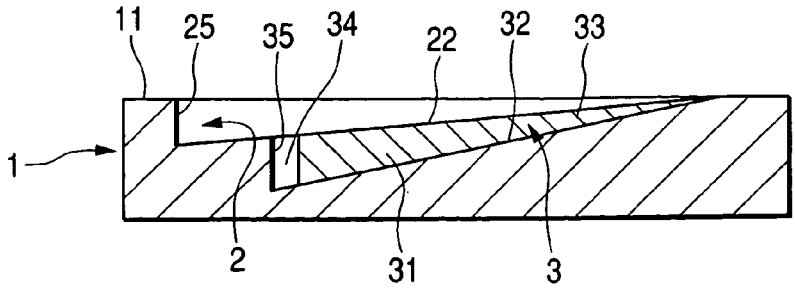
FIG. 12 is a front sectional view of the discharge tray shown in FIG. 11.
Figure 13:
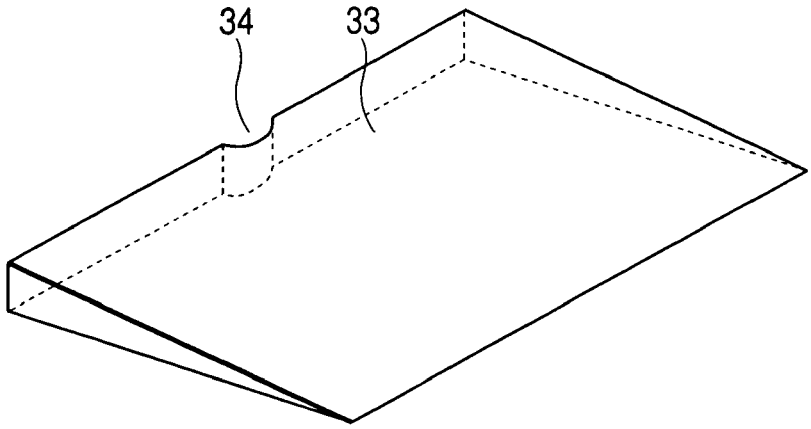
FIG. 13 is a perspective view showing an outline constitution of the fitting auxiliary member used in the discharge tray shown in FIG. 11.

Next, an explanation will be given of still other embodiment of the invention shown in FIG. 11 through FIG. 13. FIG. 11 is a perspective view showing an outline constitution of the discharge tray of an image forming apparatus according to still other embodiment of the invention, FIG. 12 is a front sectional view of the discharge tray shown in FIG. 11, and FIG. 13 is a perspective view showing an outline constitution of a fitting auxiliary member used in the discharge tray shown in FIG. 11. Further, in FIG. 11 through FIG. 13, portions attached with notations the same as those of FIG. 1 through FIG. 10 designate substantially the same portions. An explanation will be given centering on a point of difference as follows.

According to the embodiment, the sheet laminating faces 22, 32 of the first partition region 2 in the square shape and the second partition region 3 in the square shape are formed to be lowered from, for example, the carrying reference S to sides 25, 35 opposed thereto. Therefore, the fitting auxiliary member 33 fit to the dropping groove 31 forming the second partition region 3 in the square shape is formed in a wedge-like shape as shown by FIG. 13.

According to the constitution, the sheet laminating faces 22, 32 of the first partition region 2 in the square shape and the second partition region 3 in the square shape are inclined to the discharge tray face 11 and therefore, sheets discharged from the discharge port are laminated in a state of firmly aligning successively respectively along the side 25 or the side 35 and therefore, the constitution is preferable.

Figure 14:
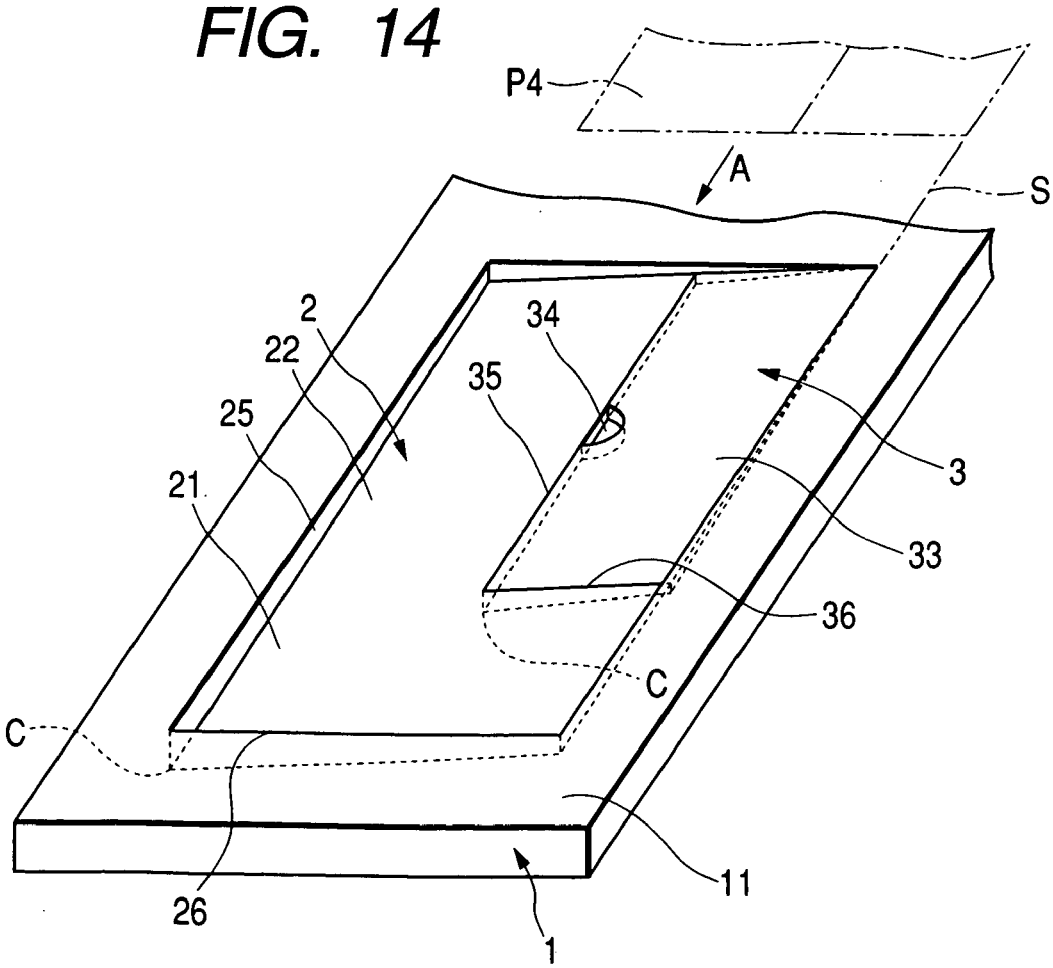
FIG. 14 is a perspective view showing an outline constitution of a discharge tray of an image forming apparatus according to still other embodiment of the invention.
Figure 15:
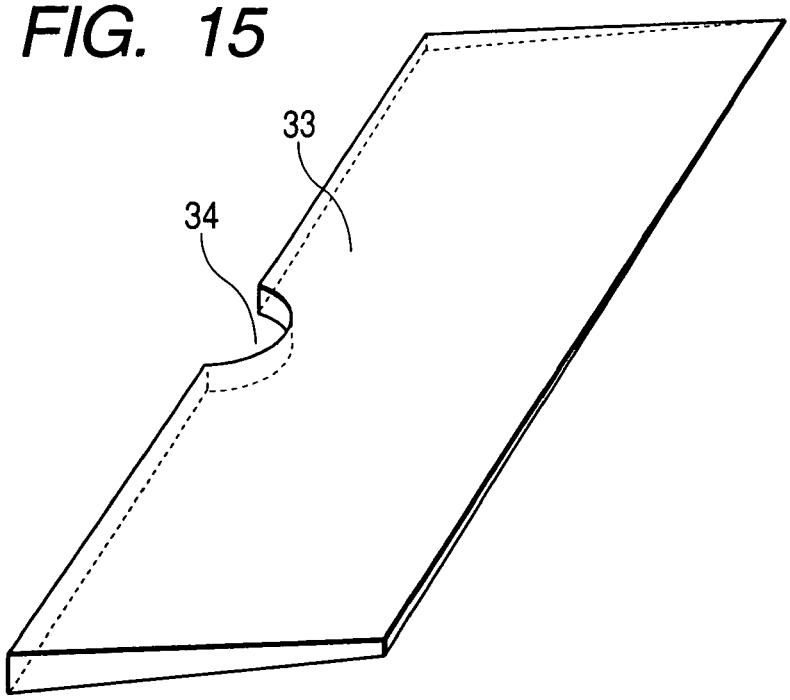
FIG. 15 is a perspective view showing an outline constitution of a fitting auxiliary member used in the discharge tray shown in FIG. 14.
Figure 16:
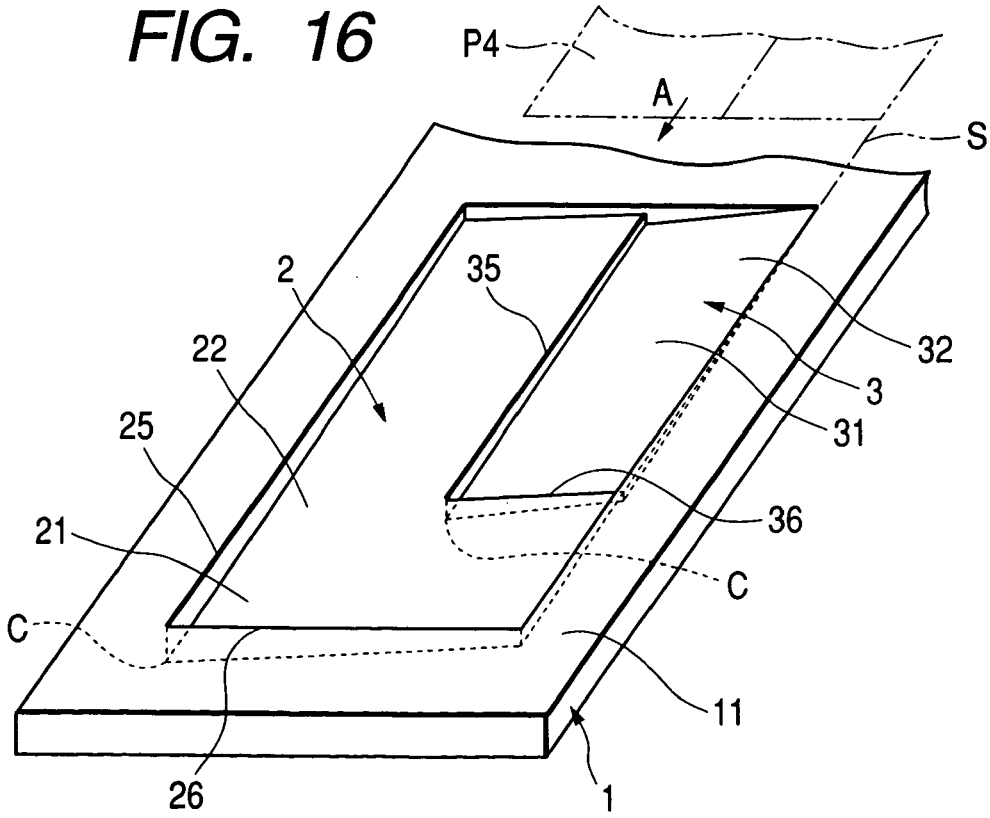
FIG. 16 is a perspective view showing a state of removing the fitting auxiliary member from the discharge tray shown in FIG. 14.

Next, an explanation will be given of still other embodiment of the invention shown in FIG. 14 through FIG. 16. FIG. 14 is a perspective view showing an outline constitution of a discharge tray of an image forming apparatus according to still other embodiment of the invention, FIG. 15 is a perspective view showing an outline constitution of a fitting auxiliary member used in the discharge tray shown in FIG. 14, and FIG. 16 is a perspective view showing a state of removing the fitting auxiliary member from the discharge tray shown in FIG. 14. Further, in FIG. 14 through FIG. 16, portions attached with notations the same as those of FIG. 1 through FIG. 13 designate substantially the same portions. An explanation will be given centering on a point of difference as follows.

According to the embodiment, the sheet laminating faces 22, 32 of the first partition region 2 in the square shape and the second partition region 3 in the square shape are formed to be lowered from, for example, the carrying reference S to corners C constituted by intersecting the sides 25, 35 opposed thereto and sides 26, 36 on sides remote from the discharge port in the direction A of discharging sheets to form to incline to the discharge tray face 21. Therefore, the fitting auxiliary member 3 fit to the dropping groove 31 forming the second partition region 3 in the square shape is formed in a modified wedge-like shape as shown by FIG. 15.

According to the constitution, since the sheet laminating faces 22, 32 of the first partition region 2 in the square shape and the second partition region 3 in the square shape are respectively inclined to the discharge tray face 11 toward the corners C and therefore, sheets discharged from the discharge port are laminated successively along the side 25 and the side 26 or the side 35 and the side 36 by constituting the references by the corners C in a state of firmly aligning the sheets and therefore, the constitution is preferable.

Further, although the above-described embodiments are preferable embodiments of the invention, the invention is not limited thereto but can variously modified to embody within the range of not deviating the gift of the invention.

What is claimed is:

1. An image forming apparatus comprising:

a discharge port for discharging a sheet having a formed image; and a discharge tray, disposed on a downstream side of the discharge port, that receives the sheet discharged from the discharge port, wherein the discharge tray includes first and second partition regions each adapted to receive one of a plurality of different sized sheets discharged to the discharge tray, wherein the first partition region including a bottom face arranged to receive a first sized sheet, and wherein the second partition region includes a bottom face, parallel to the bottom face of the first partition region, arranged to receive a second sized sheet.

2. The image forming apparatus according to claim 1, wherein the second partition region is a dropping groove.

3. The image forming apparatus according to claim 2, wherein:

the second partition region is arranged inside of the first partition region, the discharge tray further comprises a fitting auxiliary member detachably arranged in the second partition region.

4. The image forming apparatus according to claim 3, wherein an attaching and detaching groove for attaching and detaching the auxiliary member is formed at at least one side on a boundary line of the fitting auxiliary member.

5. The image forming apparatus according to claim 2, wherein a raised portion in a curved shape is formed at an end portion orthogonal to a direction of discharging the sheet in boundary lines of a fitting auxiliary member.

6. The image forming apparatus according to claim 3, wherein a raised portion in a curved shape is formed at an end portion orthogonal to a direction of discharging the sheet in boundary lines of the fitting auxiliary member.

7. An image forming apparatus comprising:

a discharge port for discharging a sheet, having a formed image, in a first direction; and a discharge tray, disposed on a downstream side of the discharge port, that receives the sheet discharged from the discharge port, wherein the discharge tray includes a partition region with a shape adapted to a first sized sheet discharged to the discharge tray, wherein a face of the partition region is inclined with respect to a face of the discharge tray to form an inclined region, the inclined region adapted to a second sized sheet, wherein the inclined region is inclined in a direction transverse to the first direction.

8. The image forming apparatus according to claim 7, wherein the inclination is formed toward any one corner of the partition region.

9. The image forming apparatus according to claim 1, wherein the discharge tray comprises a take-out groove for taking out the sheet received in the second partition region is formed at a position brought into contact with at least one side of the second partition region.

10. The image forming apparatus according to claim 9, wherein a portion of the take-out groove is extended to below a sheet face.

11. An image forming apparatus comprising:

a discharge port arranged to discharging a sheet; and a discharge tray disposed on a downstream side of the discharge port for receiving the sheet discharged from the discharge port, wherein the discharge tray includes a first partition region arranged to receive a first sized sheet and a second partition region arranged to receive a second sized sheet, and wherein the first partition region is arranged above the second partition region, wherein the second partition region is a dropping groove wherein the second partition region is arranged inside of the first partition region, and wherein the discharge tray further comprises a fitting auxiliary member detachably arranged in the second partition region.

12. The image forming apparatus according to claim 11, wherein an attaching and detaching groove for attaching and detaching the auxiliary member is formed at at least one side on a boundary line of the fitting auxiliary member.

13. The image forming apparatus according to claim 12, wherein a raised portion in a curved shape is formed at an end portion orthogonal to a direction of discharging the sheet in boundary lines of the fitting auxiliary member.

14. The image forming apparatus according to claim 11, wherein a raised portion in a curved shape is formed at an end portion orthogonal to a direction of discharging the sheet in boundary lines of the fitting auxiliary member.

15. The image forming apparatus according to claim 11, wherein the discharge tray comprises a take-out groove for taking out the sheet received in the second partition region is formed at a position brought into contact with at least one side of the second partition region.

16. The image forming apparatus according to claim 15, wherein a portion of the take-out groove is extended to below a sheet face.

* * * * *